US011622428B1

(12) United States Patent
Tan

(10) Patent No.: US 11,622,428 B1
(45) Date of Patent: Apr. 4, 2023

(54) CONSTANT CURRENT LED DRIVER, CURRENT CONTROL CIRCUIT AND PROGRAMMABLE CURRENT SOURCE

(71) Applicant: PixArt Imaging Inc., Hsin-Chu (TW)

(72) Inventor: Kok Siang Tan, Penang (MY)

(73) Assignee: PixArt Imaging Inc., Hsin-Chu (TW)

( * ) Notice: Subject to any disclaimer, the term of this patent is extended or adjusted under 35 U.S.C. 154(b) by 0 days.

(21) Appl. No.: 17/748,042

(22) Filed: May 19, 2022

(51) Int. Cl.
*H05B 45/30* (2020.01)
*H05B 45/345* (2020.01)
*H05B 45/347* (2020.01)
*H05B 45/397* (2020.01)

(52) U.S. Cl.
CPC ..... *H05B 45/345* (2020.01); *H05B 45/347* (2020.01); *H05B 45/397* (2020.01)

(58) Field of Classification Search
CPC ..... H05B 45/38; H05B 45/46; H05B 45/375; H05B 45/385; H05B 45/397; H05B 45/3725
See application file for complete search history.

(56) References Cited

U.S. PATENT DOCUMENTS 8,035,311 B2 * 10/2011 Prexl ..... H05B 45/375 315/225
8,704,450 B2 * 4/2014 Chen ..... H05B 45/46 315/307
9,420,653 B2 * 8/2016 Van de Maele ..... H05B 45/46
2008/0224634 A1 * 9/2008 Scilia ..... H05B 45/18 315/192
2010/0013412 A1 * 1/2010 Archibald ..... H05B 45/46 315/294
2017/0142786 A1 * 5/2017 Cai ..... H03K 17/6872
2019/0380180 A1 * 12/2019 Miyajima ..... H02M 1/08
2021/0385924 A1 * 12/2021 Seminara ..... H05B 45/325

* cited by examiner

*Primary Examiner* — Tung X Le
(74) *Attorney, Agent, or Firm* — Winston Hsu

(57) ABSTRACT

A constant current LED driver, for controlling a current flowing through a LED, comprising: an adjusting circuit, configured to generate a first current and a first adjusting signal; a feedback circuit, controlled by an output signal, to generate a feedback voltage according to the first current; an operation amplifier, configured to generate the output signal according to the LED voltage and the feedback voltage; and an edge adjusting circuit, configured to adjust a first type of edges or a second type of edges of the first adjusting signal to generate a second adjusting signal, wherein the LED is controlled by the second adjusting signal. The above-mentioned constant current LED driver can be used as a current control circuit for controlling a current flowing through a target device.

20 Claims, 5 Drawing Sheets

CONSTANT CURRENT LED DRIVER, CURRENT CONTROL CIRCUIT AND PROGRAMMABLE CURRENT SOURCE

BACKGROUND OF THE INVENTION

1. Field of the Invention

The present invention relates to a constant current LED driver, a current control circuit and a programmable current source, and particularly relates to a constant current LED driver, a current control circuit which can save power consumption and a programmable current source which has a fast turn on time.

2. Description of the Prior Art

LED current plays a significant role to determine power consumption of an optical mouse. However, the LED current may vary responding to change of external component parameters such as LED operation voltage and temperature. Besides, the LED driver may have higher headroom since transistors therein may be stacked. Furthermore, a conventional LED driver always has a cascade structure, which may have a larger circuit area and larger background currents.

Therefore, a new LED driver is needed to improve these issues.

SUMMARY OF THE INVENTION

Therefore, one objective of the present invention is to provide a LED driver which can provide a stable LED current.

Another objective of the present invention is to provide a LED driver which has a smaller circuit area.

Still another objective of the present invention is to provide a programmable current source which has a fast turn on time.

One embodiment of the present invention discloses a constant current LED driver, for controlling a current flowing through a LED, comprising: an adjusting circuit, configured to generate a first current and a first adjusting signal; a feedback circuit, controlled by an output signal, to generate a feedback voltage according to the first current; an operation amplifier, comprising a first input terminal, a second input terminal, wherein the first input terminal is configured to receive a LED voltage generated by the LED, wherein the second input terminal is configured to receive the feedback voltage, wherein the operation amplifier generates the output signal according to the LED voltage and the feedback voltage; and an edge adjusting circuit, configured to adjust a first type of edges or a second type of edges of the first adjusting signal to generate a second adjusting signal, wherein the LED is controlled by the second adjusting signal.

The above-mentioned constant current LED driver can be used as a current control circuit for controlling a current flowing through a target device.

Another embodiment of the present invention discloses a programmable current source, comprising: a bit line; a reference current generating circuit, comprising a first transistor, configured to provide a reference current flowing through the first transistor; a current mirror, comprising a second transistor and a third transistor, configured to generate a first mirrored current flowing through the second transistor corresponding to the reference current, and configured to generate a second mirrored current flowing through the third transistor corresponding to the first mirrored current; a programmable bit circuit, controlled by bits transmitted by the bit line, to generate a first current corresponding to the second mirrored current.

In one embodiment, a first parasitic capacitor exists between the bit line, a control terminal of the first transistor and a control terminal of the second transistor; a second parasitic capacitor exists between the bit line, the programmable bit circuit, and a control terminal of the third transistor, wherein a capacitance of the second parasitic capacitor is larger than a capacitance of the first parasitic capacitor.

In view of above-mentioned embodiments, the rise and fall time of the LED driver can be controlled to mitigate EMI issue and prevent large inrush current. Also, a fine step current control function is provided. Further, a circuit to switch a constant LED driver to a switch-based LED driver based on applications requirement is provided. Additionally, a circuit to increase LED turn-on time is provided.

These and other objectives of the present invention will no doubt become obvious to those of ordinary skill in the art after reading the following detailed description of the preferred embodiment that is illustrated in the various figures and drawings.

DETAILED DESCRIPTION

Several embodiments are provided in following descriptions to explain the concept of the present invention. The term "first", "second", "third" in following descriptions are only for the purpose of distinguishing different one elements, and do not mean the sequence of the elements. For example, a first device and a second device only mean these devices can have the same structure but are different devices.

Figure 1:
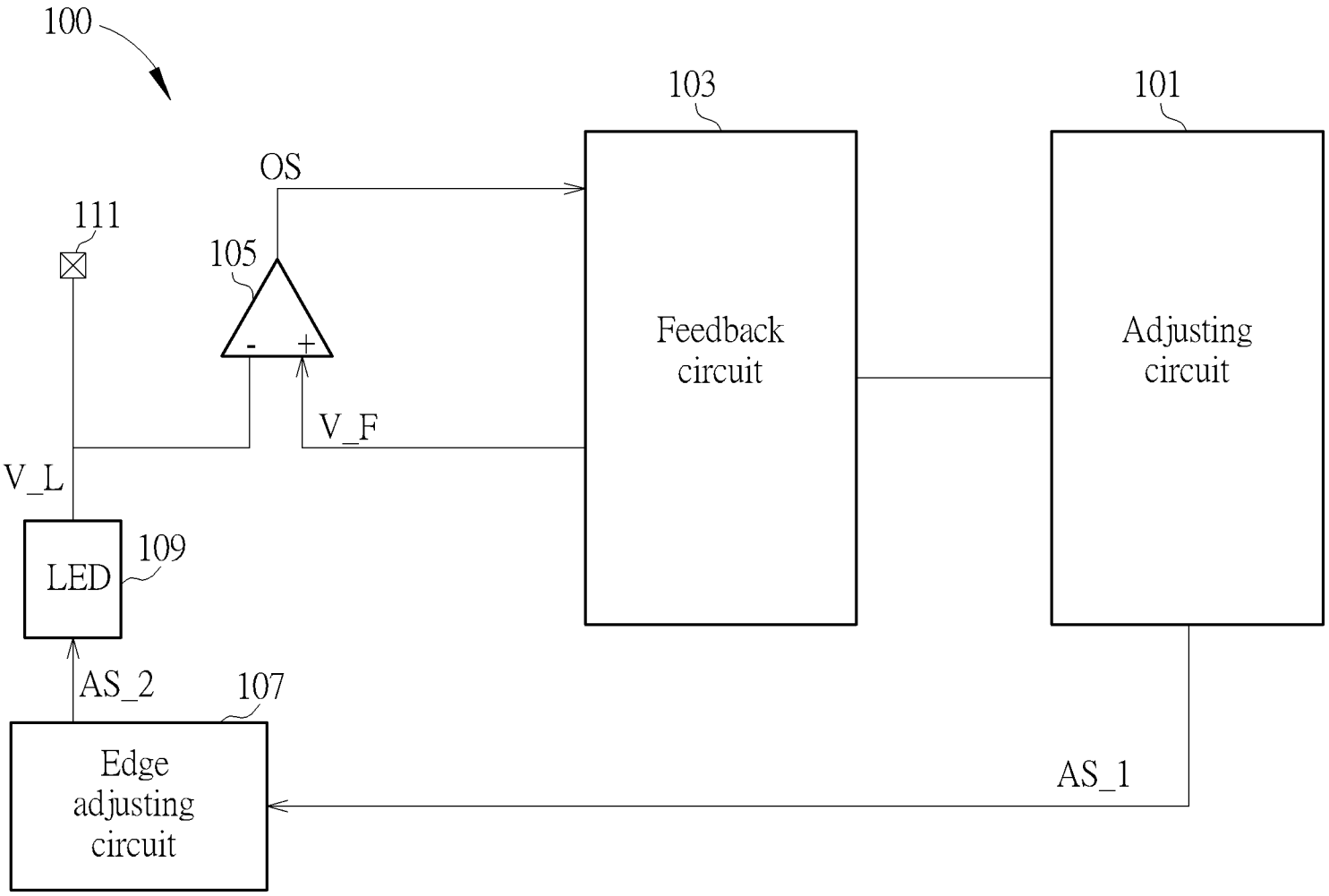
FIG. 1 is a block diagram illustrating a constant current LED driver according to one embodiment of the present invention.

FIG. 1 is a block diagram illustrating a constant current LED driver 100 according to one embodiment of the present invention, which controls a current flowing through a LED. As illustrated in FIG. 1, the constant current LED driver 100 comprises an adjusting circuit 101, a feedback circuit 103, an OP (operation amplifier) 105, and an edge adjusting circuit 107. The adjusting circuit 101 is configured to generate a first current and a first adjusting signal AS_1. The first current will be explained in FIG. 2.

The feedback circuit 103 is controlled by an output signal OS, to generate a feedback voltage V_F according to the first current. The OP 105 comprises a first input terminal (negative terminal in this embodiment) and a second input terminal (positive terminal in this embodiment). The first input terminal is configured to receive a LED voltage V_L generated by the LED (Light Emitting Diode) 109. The second input terminal is configured to receive the feedback voltage V_F. The OP 105 generates the output signal OS according to the LED voltage V_L and the feedback voltage V_F. The edge adjusting circuit 107 is configured to adjust a first type of edges or a second type of edges of the first adjusting signal AS_1 to generate a second adjusting signal AS_2. The LED 109 is controlled by the second adjusting signal AS_2. In one embodiment, a pad 111 is coupled to the first input terminal of the OP 105 and the LED 109. In one embodiment, the OP 105 generates the output signal OS corresponding to variation of the LED voltage V_L, to adjust the feedback voltage V_F corresponding to the variation. By this way, the LED voltage V_L is adjusted corresponding to the feedback voltage V_F, thereby a constant LED current can be acquired.

Figure 2:
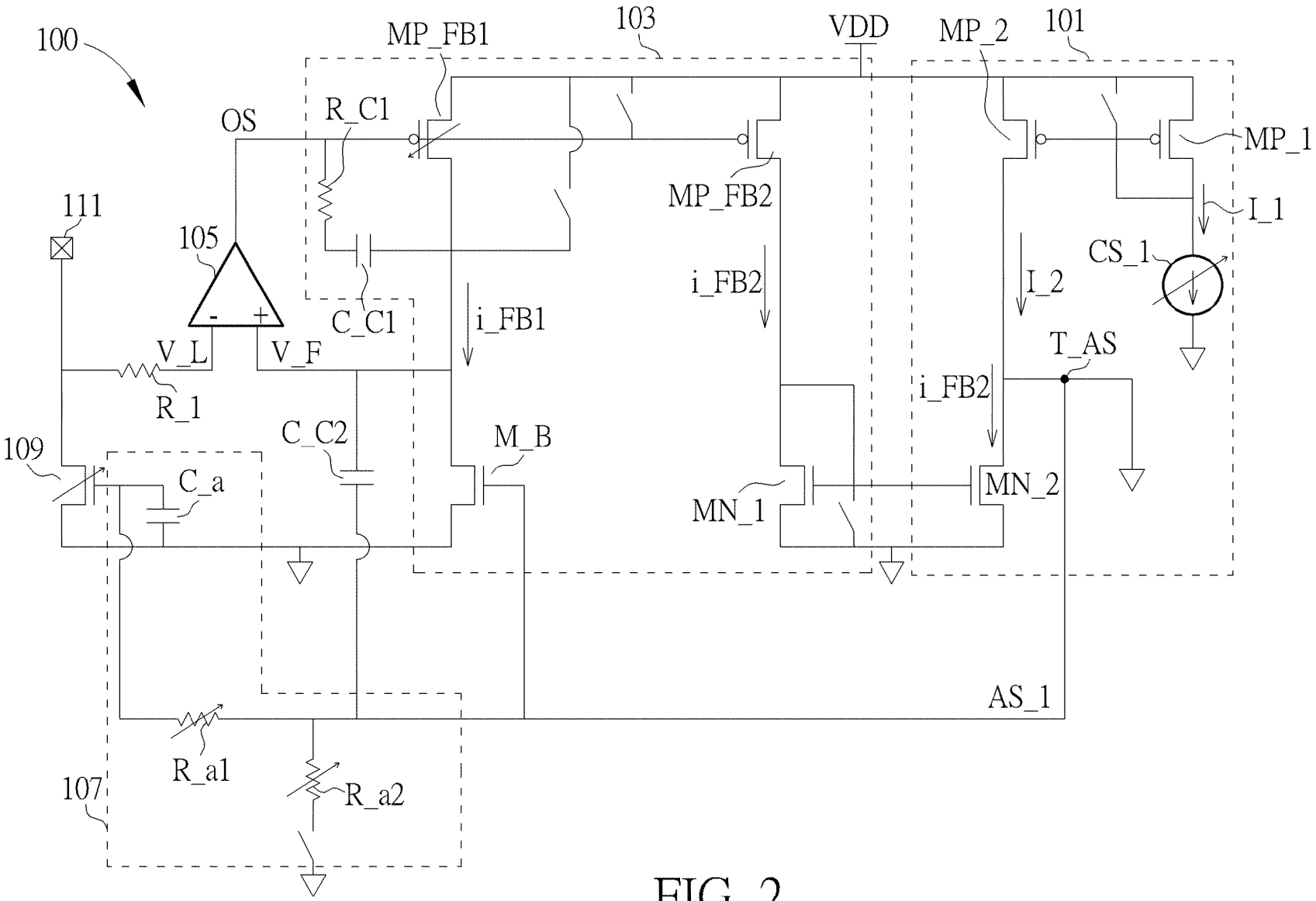
FIG. 2 and FIG. 3 are circuit diagrams illustrating circuitries of the constant current LED driver in FIG. 1, according to embodiments of the present invention.

FIG. 2 is a circuit diagram illustrating circuitries of the constant current LED driver 100 in FIG. 1, according to one embodiment of the present invention. Please note FIG. 2 is only an example for explaining. Other circuitries which can reach the same function should also fall in the scope of the present invention. As illustrated in FIG. 2, the adjusting circuit 101 comprises PMOSs MP_1, MP_2, a NMOS MN_2, a capacitor C_X and a first current generating circuit CS_1. The PMOSs MP_1, MP_2 form a current mirror. The first current generating circuit CS_1 is configured to generate the above-mentioned first current I_1. The first current I_1 is mirrored to generate the current I_2. In one embodiment, the OP 105 and the feedback circuit 103 are configured to adjust the current i_FB2 to be equal to the current I_2, such that the feedback voltage V_F is equal to the LED voltage V_L. Details of this step will be described for more detail later.

The feedback circuit 103 comprises PMOSs MP_FB1, MP_FB2, NMOSs MN_1, M_B. The PMOSs MP_FB1, MP_FB2 forma current mirror. The current i_FB1 corresponds to the current i_FB2. As above-mentioned, the OP 105 and the feedback circuit 103 are configured to adjust the current i_FB2 to be equal to the current I_2. The current I_2 can be called a current I_main. The ratio between a value of the I_main and a value of the LED current (the current flowing through the LED 109) is set by all the current mirror ratios. In such case, the output signal OS adjusts the PMOS MP_FB2, and the PMOS MP_FB1 is adjusted correspondingly, since a gate of the PMOS MP_FB1 also receives the output signal OS. By this way, the current I_FB2 can be adjusted and a current for the NMOS M_B can also be acquired.

Additionally, in the embodiment of FIG. 2, the LED 109 is a transistor. In the embodiment of FIG. 2, the constant current LED driver 100 further comprises a resistor R_1, which is coupled between the pad 111 and the first input terminal and is used for ESD protection. However, in another embodiment, the resistor R_1 can be removed.

In the embodiment of FIG. 2, the edge adjusting circuit 107 comprises a capacitor C_a, resistors R_a1 and R_a2. In one embodiment, the capacitor C_a is parasitic capacitance of the LED 108. The capacitor C_a and the resistor R_a1 form a RC delay circuit configured to delay the first type of edges. The LED 109 turns on responding to the first type of edges. The resistor R_a2 is for controlling time of the second type of edges, and the LED 109 turns off corresponding to the second type of edges. In one embodiment, the first type of edges are rising edges and the second type of edges are falling edges.

Detail connections of the components in the constant current LED driver 100 are clearly illustrated in FIG. 2, thus descriptions thereof are omitted for brevity here. An example of detail operations of the constant current LED driver 100 in FIG. 2 will be described below. Please note, the constant current LED driver 100 comprises a plurality of switches, which can be controlled to turn on or turn off corresponding the on/off the LED 09.

Initially, the LED 109 is off. In such case, the constant current LED driver 100 is off. The voltage from the pad 111 is high, thus voltages at an output terminal of the OP 105 and the second input terminal are also pulled high to VDD and all PMOSs in the adjusting circuit 101 and the feedback circuit 103 are off too. As a result, no background current is consumed. The background current means the currents which the whole circuit needs while operating.

When the LED 109 is on, the first current I_1 and the current I_2 are generated and the OP 105 also turns on. Once a voltage of the first adjusting signal AS_1 reaches a threshold, the LED 109 and the NMOS M_B are turned on and voltages at the first input terminal, the second input terminal of the OP 105 decrease. The OP 105 senses voltages at the first input terminal, the second input terminal and thereby generate the output signal OS to turn on PMOSs MP_FB1 and MP_FB2. Based on close-loop feedback mechanism by the OP 105, the current i_FB2 becomes equal to the current I_2. As a result, the voltages at the first input terminal, the second input terminal are equal. The Vds of NMOS M_B and LED 109 are equal, thereby removing the 2nd and 3rd order effect of the transistor behavior. Hence an accurate LED current (the current flowing through the LED 109) can be achieved. In one embodiment, the constant current LED driver 100 further comprise a resistor R_C1 and capacitors C_C1, C_C2 for frequency compensation, but not limited.

If the LED voltage V_L varies, the OP 105 corresponding changes the output signal OS to control the operations of the feedback circuit 103, thus the adjusting circuit 101 correspondingly operates. By this way, the first adjusting signal AS_1 correspondingly changes to control the LED 109.

As above-mentioned, the edge adjusting circuit 107 is configured to adjust rising edges or falling edges of the first adjusting signal AS_1 to generate a second adjusting signal AS_2. A traditional constant current driver does not have a function to control the rise time (time of rising edges) and fall time (time of falling edges) of the LED driver. Usually the rise time is governed by the closed-loop response of the feedback system. If the rise response is too fast, it will generate some large current peaking which is not acceptable in some applications. As for the fall time is usually very fast because the power down transistor will pull the terminal T_AS of the adjusting circuit 101 which outputs the first adjusting signal AS_1 to ground by a buffer. These fast rise time and fall time is not good for EMI (Electromagnetic Interference) and also generates large inrush currents.

The edge adjusting circuit 107 in FIG. 1 and FIG. 2 of the present invention can improve such issue. During the time that the LED 109 turns on, the resistor R_a1 is part of the close-loop feedback system. The R_a1 and the C_a of form a RC delay circuit so that it slows down the rise time. Moreover it can suppress the peak LED current as well, as the RC delay will dampen the response. During the time that the LED 109 turns off, all PMOSs in the adjusting circuit 101 and the feedback circuit 103, thus the adjusting circuit 101 does not output any current by the terminal T_AS. The terminal T_AS is discharged slowly by a switch to ground through the resistor R_a2. Thus the fall time can be adjusted.

In one embodiment, the gain ratios of each current mirror can be set to match the requirements of the LED current. For example, MP_1/MP_2=1, MN_2/MN_1=1, MPFB_1/MPFB_2=5× and MLED/M_B=400×. This translates to the current gain of 2000× which is relatively large. It is to minimize the background current without sacrificing matching accuracy. By setting some of the ratio numbers to be the same, the background current can be reduced thus the power consumption is low.

Figure 3:
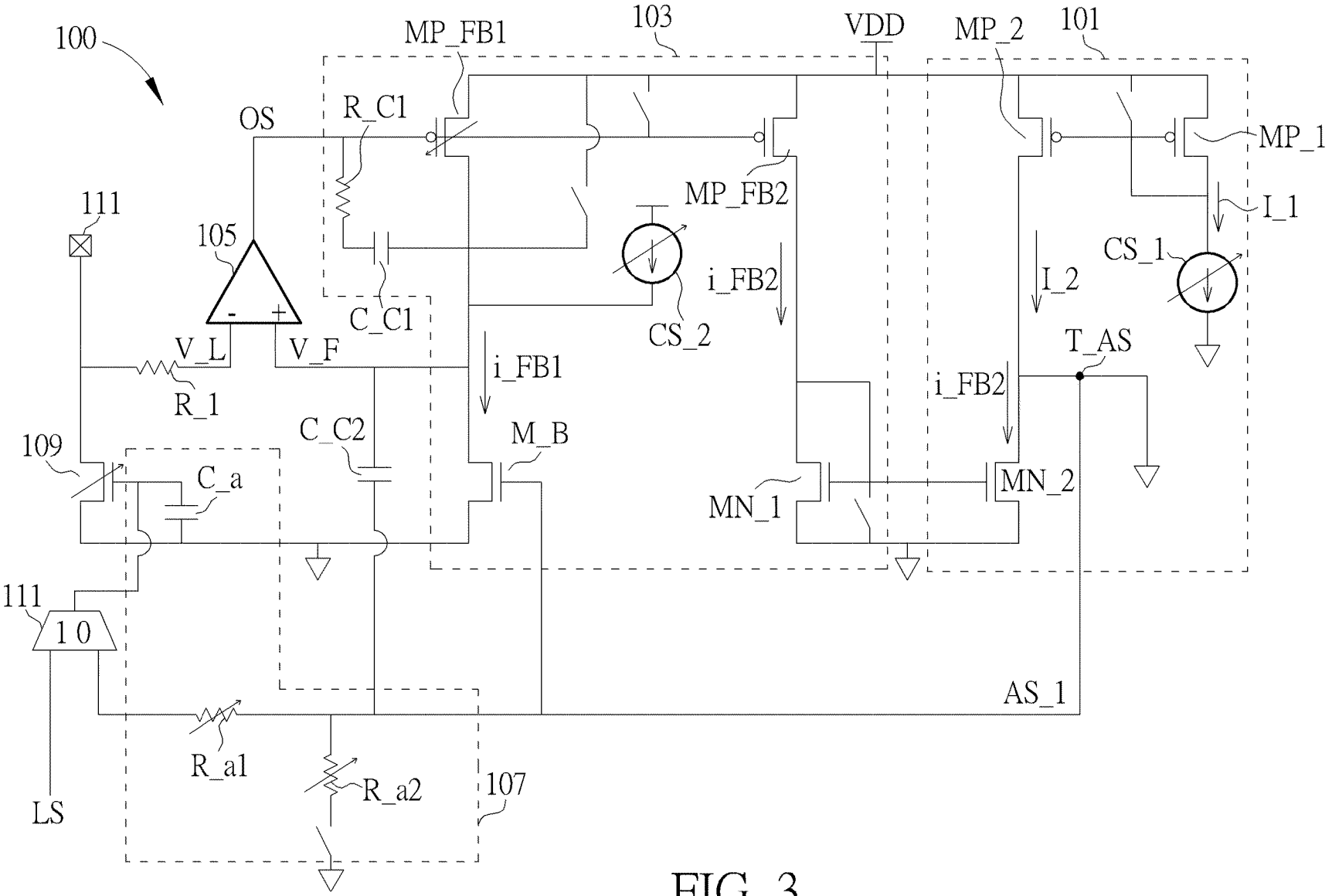

Besides the edge adjusting circuit 107, the constant current LED driver can further comprise other mechanism for improving the performance there. In the embodiment of FIG. 3, the feedback circuit 103 comprises a first current source formed by the PMOS MP_FB1. The first current source is configured to provide a first feedback current i_FB1. Also, the feedback circuit 103 further comprises a second current source CS_2, which is configured to provide a second feedback current smaller than the first feedback current. The NMOS M_B, which is coupled to the first current source, the second current source and a ground voltage level, comprises a first terminal (source) coupled to the LED 109 and a control terminal (gate) receiving the first adjusting signal AS_1. The NMOS M_B further comprises a second terminal (drain) configured to receive the first feedback current i_FB1 in a normal mode and configured to receive the second feedback current in a second mode (or named a fine step mode).

For more detail, in the first mode, the NMOS M_B receives the current i_FB1 and accordingly controls the LED current of the LED 109. However, in some embodiments, the current i_FB1 is generated corresponding to the current i_FB2 by the PMOS MP_FB2. In such case, the LED current changes too much since the current i_FB1 is large, thus the LED current has a coarse step size. Therefore, in the second mode, the NMOS M_B receives the smaller second feedback current rather than the larger first feedback current, and accordingly controls the LED current of the LED 109. By this way, the change of the LED current can be more smooth since the second current is small, thus the LED current has a better step size.

In the embodiment of FIG. 3, the constant current LED driver 100 further comprises a mode switch circuit 111, which selectively controls the LED 109 to operate in a third mode or in a fourth mode. The LED 109 receives a control signal LS to turn on or turns off in the third mode. Also, the LED 109 is not controlled by the second adjusting signal AS_2 in the third mode. Besides, the LED 109 is controlled by the second adjusting signal AS_2 in the fourth mode.

In other words, in the third mode, the LED 109 is directly controlled by the control signal LS thus works as a switch to turn on or turn off. In such case, the constant current LED driver 100 is a switch-based LED driver, which can provide a large LED current. The OP 105, and the PMOSs in the adjusting circuit 101 and the feedback circuit 103 turn off in the third mode. Further, in the fourth mode, the constant current LED driver 100 is a constant LED driver, which operates as illustrated in above-mentioned embodiments.

Figure 4:
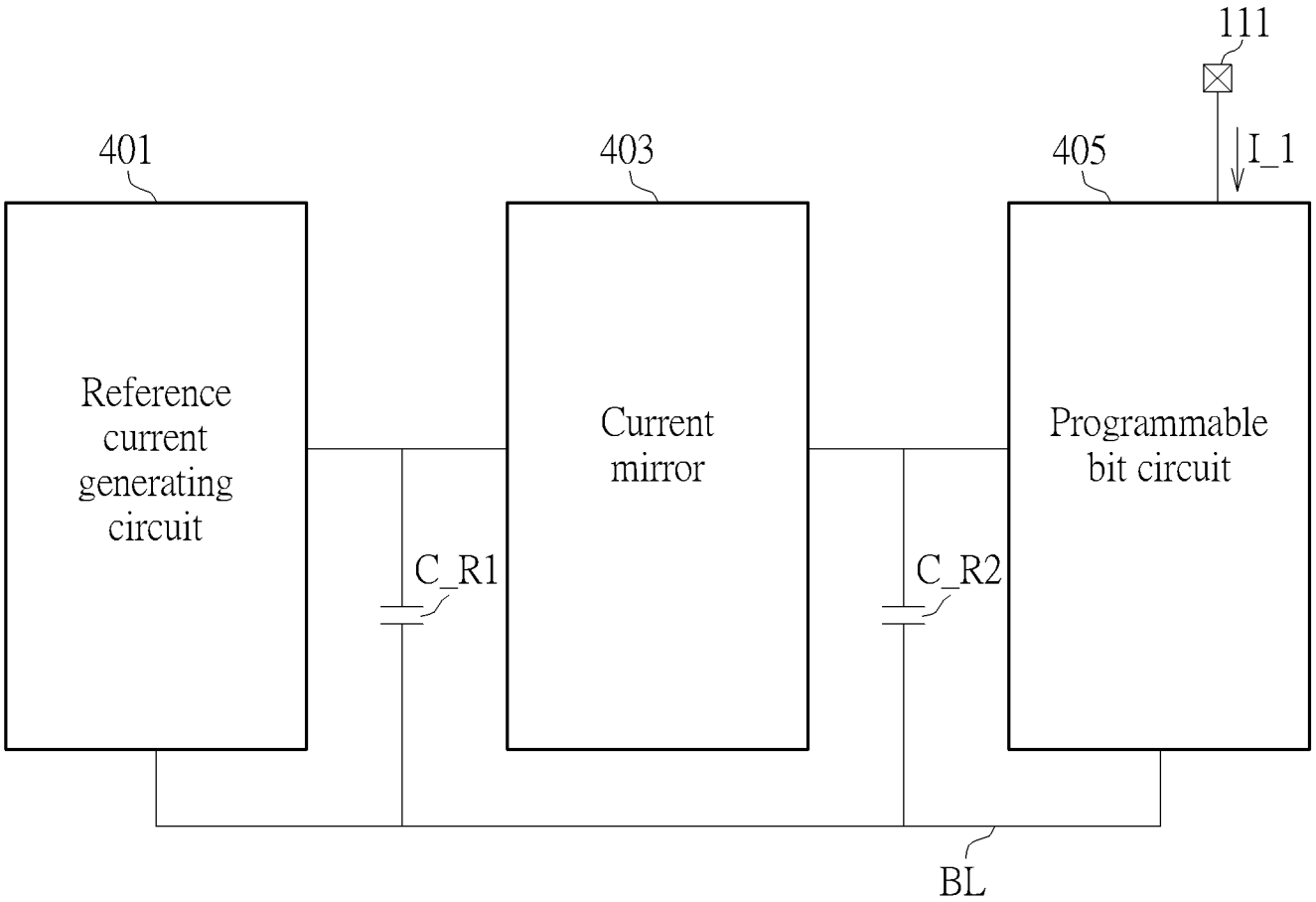
FIG. 4 is a block diagram illustrating a programmable current source according to one embodiment of the present invention.

AS above-mentioned, the adjusting circuit 101 comprises a first current generating circuit CS_1. The present invention also provides a mechanism for improving the first current generating circuit CS_1. FIG. 4 is a block diagram illustrating a programmable current source 400 according to one embodiment of the present invention. The programmable current source 400 can be applied as the first current generating circuit CS_1 in FIG. 2 and FIG. 3. However, the programmable current source 400 can be applied to other applications.

As illustrated in FIG. 4, the programmable current source 400 comprises a bit line BL, a reference current generating circuit 401, a current mirror 403, and a programmable bit circuit 405. The reference current generating circuit 401 comprises a first transistor, configured to provide a reference current flowing through the first transistor. The first transistor and the reference current will be described in FIG. 5.

The current mirror 403 comprises a second transistor and a third transistor, configured to generate a first mirrored current flowing through the second transistor corresponding to the reference current, and configured to generate a second mirrored current flowing through the third transistor corresponding to the first mirrored current. The second transistor and the third transistor will be described in FIG. 5. The programmable bit circuit 405 is controlled by bits transmitted by the bit line BL, to generate the first current I_1 corresponding to the second mirrored current.

For such structure, a first parasitic capacitor C_R1 exists between the bit line, a control terminal of the first transistor and a control terminal of the second transistor. Further, a second parasitic capacitance C_R2 exists between the bit line BL, the programmable bit circuit 405, and a control terminal of the third transistor. A capacitance of the second parasitic capacitor C_R2 is larger than a capacitance of the first parasitic capacitor C_R1.

Figure 5:
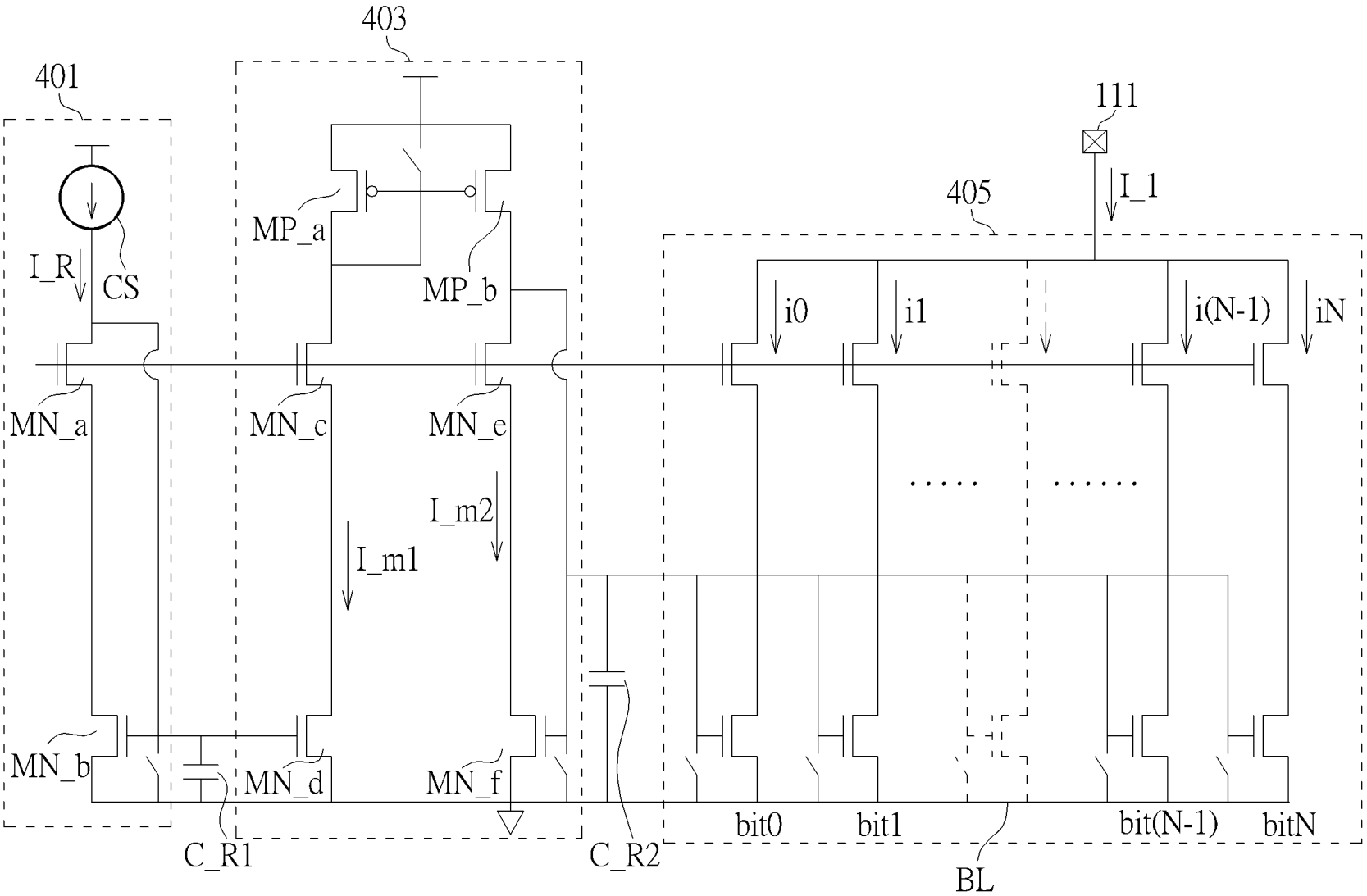
FIG. 5 is a circuit diagram illustrating a circuitry of the programmable current source in FIG. 4, according to one embodiment of the present invention.

FIG. 5 is a circuit diagram illustrating a circuitry of the programmable current source in FIG. 4, according to one embodiment of the present invention. As illustrated in FIG. 5, the reference current generating circuit 401 comprises a current source CS, and NMOSs MN_a, MN_b. The NMOS MN_b is the above-mentioned first transistor and the current I_R is the above-mentioned reference current. Also, the current mirror 403 comprises PMOSs MP_a, MP_b, and NMOSs MN_c, MN_d, MN_e, and MN_f. The NMOS MN_d is the above-mentioned second transistor, and the NMOS MN_f is the above-mentioned third transistor. Besides, the current I_m1 is the above-mentioned first mirrored current, and the current I_m2 is the above-mentioned second mirrored current. The programmable bit circuit 405 comprises a plurality of NMOSs which are controlled by bits bit0, bit1 . . . transmitted by the bit line BL. Based on the bits and the structure in FIG. 5, the first current I_1 corresponding to the second mirrored current I_m2 can be generated. Please note, in the embodiment of FIG. 5, the programmable bit circuit 405 comprises a plurality of switches, which can be applied to control the on/off of transistors therein. Also, gates of the NMOSs MN_a, MN_c, MN_e and the NMOSs of the programmable bit circuit 405 are coupled together, thus can be controlled by a single signal.

For a conventional programmable current source, no current mirror is comprised, thus the reference current generating circuit and the programmable bit circuit thereof are directly connected. Accordingly a parasitic capacitor is formed between the reference current generating circuit and the programmable bit circuit. Such parasitic capacitor has a relatively large capacitance since it is connected to many programmable NMOS transistor gates. Furthermore, for low power applications, the reference current I_R is usually small. As a result, the turn on time of the LED driver becomes slow.

In order to solve such problems, in the embodiments of FIG. 4 and FIG. 5 of the present application, a new stage (the current mirror 403) is added in to decouple the path of the reference current I_R and the programmable current bits, so that the parasitic capacitor becomes smaller, and thereby the voltage for biasing transistors is established faster. Furthermore the current I_m2 can be set to larger value by setting the gain ratios of PMOSs MP_a, MP_b, further improving the turn on time. If the current I_m2 current is dynamically increase to be larger than the current I_m1 for a short time when LED is on, it also can improve the turn on time.

In view of above-mentioned embodiments, the rise and fall time of the LED driver can be controlled to mitigate EMI issue and prevent large inrush current. Also, a fine step current control function is provided. Further, a circuit to switch a constant LED driver to a switch-based LED driver based on applications requirement is provided. Additionally, a circuit to increase LED turn-on time is provided.

The constant LED driver provided by the present invention has lower headroom since no stacked transistors are used. Also, no third order transistor effect exists. The constant LED drivers provided by the present invention are insensitive to external component parameters such as VDD. Also, the area efficient is high and a large current gain ratio is achieved more easily since no cascade structure is used.

However, it will be appreciated that the present invention is not limited to a constant current LED driver. The above-mentioned embodiments can be applied to a current control circuit for any other light source or any other target device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A constant current LED driver, for controlling a current flowing through a LED, comprising:

an adjusting circuit, configured to generate a first current and a first adjusting signal;

a feedback circuit, controlled by an output signal, to generate a feedback voltage according to the first current;

an operation amplifier, comprising a first input terminal, a second input terminal, wherein the first input terminal is configured to receive a LED voltage generated by the LED, wherein the second input terminal is configured to receive the feedback voltage, wherein the operation amplifier generates the output signal according to the LED voltage and the feedback voltage; and an edge adjusting circuit, configured to adjust a first type of edges or a second type of edges of the first adjusting signal to generate a second adjusting signal, wherein the LED is controlled by the second adjusting signal.

2. The constant current LED driver of claim 1, wherein the edge adjusting circuit comprises:

a RC delay circuit, configured to delay the first type of edges;

wherein the LED turns on responding to the first type of edges.

3. The constant current LED driver of claim 1, wherein the edge adjusting circuit comprises a resistor for controlling time of the second type of edges;

wherein the LED turns off corresponding to the second type of edges.

4. The constant current LED driver of claim 1, wherein the feedback circuit comprises:

a first current source, configured to provide a first feedback current;

a second current source, configured to provide a second feedback current smaller than the first feedback current; and a transistor, coupled to the first current source, the second current source and a ground voltage level, comprising a first terminal coupled to the LED and a control terminal receiving the first adjusting signal;

wherein the transistor further comprises a second terminal configured to receive the first current in a first mode and configured to receive the second current in a second mode.

5. The constant current LED driver of claim 1, further comprises:

a mode switch circuit, to selectively control the LED to operate in a third mode or in a fourth mode;

wherein the LED receives a control signal to turn on or turns off in the third mode, wherein the LED is not controlled by the second adjusting signal in the third mode;

wherein the LED is controlled by the second adjusting signal in the fourth mode.

6. The constant current LED driver of claim 1, wherein the adjusting circuit comprises a first current generator, wherein the first current generator comprising:

a bit line;

a reference current generating circuit, comprising a first transistor, configured to provide a reference current flowing through the first transistor;

a current mirror, comprising a second transistor and a third transistor, configured to generate a first mirrored current flowing through the second transistor corresponding to the reference current, and configured to generate a second mirrored current flowing through the third transistor corresponding to the first mirrored current;

a programmable bit circuit, controlled by bits transmitted by the bit line, to generate the first current corresponding to the second mirrored current.

7. The constant current LED driver of claim 6, wherein a first parasitic capacitor exists between the bit line, a control terminal of the first transistor and a control terminal of the second transistor;

wherein a second parasitic capacitor exists between the bit line, the programmable bit circuit, and a control terminal of the third transistor, wherein a capacitance of the second parasitic capacitor is larger than a capacitance of the first parasitic capacitor.

8. The constant current LED driver of claim 1, wherein the operation amplifier generates the output signal corresponding to variation of the LED voltage, to adjust the feedback voltage corresponding to the variation, to control the LED voltage and the feedback voltage to be equal.

9. A current control circuit, for controlling a current flowing through a target device, comprising:

an adjusting circuit, configured to generate a first current and a first adjusting signal;

a feedback circuit, controlled by an output signal, to generate a feedback voltage according to the first current;

an operation amplifier, comprising a first input terminal, second input terminal, wherein the first input terminal is configured to receive a target voltage generated by the target device, wherein the second input terminal is configured to receive the feedback voltage, wherein the operation amplifier generates the output signal according to the target voltage and the feedback voltage; and an edge adjusting circuit, configured to adjust a first type of edges or a second type of edges of the first adjusting signal to generate a second adjusting signal, wherein the target device is controlled by the second adjusting signal.

10. The current control circuit of claim 9, wherein the edge adjusting circuit comprises:

a RC delay circuit, configured to delay the first type of edges;

wherein the target device turns on responding to the first type of edges.

11. The current control circuit of claim 9, wherein the edge adjusting circuit comprises a resistor for controlling time of the second type of edges;

wherein the target device turns off corresponding to the second type of edges.

12. The current control circuit of claim 9, wherein the feedback circuit comprises:

a first current source, configured to provide a first feedback current;

a second current source, configured to provide a second feedback current smaller than the first feedback current; and a transistor, coupled to the first current source, the second current source and a ground voltage level, comprising a first terminal coupled to the target device and a control terminal receiving the first adjusting signal;

wherein the transistor further comprises a second terminal configured to receive the first current in a first mode and configured to receive the second current in a second mode.

13. The current control circuit of claim 9, further comprises:

a mode switch circuit, to selectively control the LED to operate in a third mode or in a fourth mode;

wherein the LED receives a control signal to turn on or turns off in the third mode, wherein the LED is not controlled by the second adjusting signal in the third mode;

wherein the LED is controlled by the second adjusting signal in the fourth mode.

14. The current control circuit of claim 9, wherein the adjusting circuit comprises a first current generator, wherein the first current generator comprising:

a bit line;

an reference current generating circuit, comprising a first transistor, configured to provide a reference current flowing through the first transistor;

a current mirror, comprising a second transistor and a third transistor, configured to generate a first mirrored current flowing through the second transistor corresponding to the reference current, and configured to generate a second mirrored current flowing through the third transistor corresponding to the first mirrored current;

a programmable bit circuit, controlled by bits transmitted by the bit line, to generate the first current corresponding to the second mirrored current.

15. The current control circuit of claim 14, wherein a first parasitic capacitor exists between the bit line, a control terminal of the first transistor and a control terminal of the second transistor;

wherein a second parasitic capacitor exists between the bit line, the programmable bit circuit, and a control terminal of the third transistor, wherein a capacitance of the second parasitic capacitor is larger than a capacitance of the first parasitic capacitor.

16. The current control circuit of claim 9, wherein the operation amplifier generates the output signal corresponding to variation of the target voltage, to adjust the feedback voltage corresponding to the variation, to control the target voltage and the feedback voltage to be equal.

17. The current control circuit of claim 9, wherein the target device is a light source.

18. The current control circuit of claim 17, wherein the target device is an LED.

19. A programmable current source, comprising:

a bit line;

a reference current generating circuit, comprising a first transistor, configured to provide a reference current flowing through the first transistor;

a current mirror, comprising a second transistor and a third transistor, configured to generate a first mirrored current flowing through the second transistor corresponding to the reference current, and configured to generate a second mirrored current flowing through the third transistor corresponding to the first mirrored current; and a programmable bit circuit, controlled by bits transmitted by the bit line, to generate a first current corresponding to the second mirrored current.

20. The programmable current source of claim 19, wherein a first parasitic capacitor exists between the bit line, a control terminal of the first transistor and a control terminal of the second transistor;

wherein a second parasitic capacitor exists between the bit line, the programmable bit circuit, and a control terminal of the third transistor, wherein a capacitance of the second parasitic capacitor is larger than a capacitance of the first parasitic capacitor.

* * * * *